United States Patent [19]

Iwasa et al.

[11] 4,268,810

[45] May 19, 1981

[54] ELECTRICAL ARTICLE HAVING ELECTRICAL COIL AND METHOD FOR MANUFACTURING SAME

[75] Inventors: Yoshisuke Iwasa; Shigehiko Sakura, both of Yokohama, Japan

[73] Assignee: Sumitomo Bakelite Company Limited, Japan

[21] Appl. No.: 61,958

[22] Filed: Jul. 30, 1979

[30] Foreign Application Priority Data

| | | | |
|---|---|---|---|
| Jul. 31, 1978 | [JP] | Japan | 53-92529 |
| Jul. 31, 1978 | [JP] | Japan | 53-92530 |
| Aug. 1, 1978 | [JP] | Japan | 53-93163 |

[51] Int. Cl.[3] ..... H01F 7/06; H01H 9/00; B05D 5/12; H01F 5/06

[52] U.S. Cl. ..... 336/205; 29/605; 336/206; 427/116; 264/103; 264/135

[58] Field of Search ..... 29/605; 336/205, 206; 427/116, 121

[56] References Cited

U.S. PATENT DOCUMENTS

| | | | |
|---|---|---|---|
| 3,263,196 | 7/1966 | Reber | 336/206 |
| 3,313,879 | 4/1967 | Ford et al. | 336/206 |
| 3,352,711 | 11/1967 | Nichols | 427/116 |
| 3,503,797 | 3/1970 | Hagiwara et al. | 427/116 |
| 3,707,692 | 12/1972 | Reeder et al. | 336/206 |
| 3,991,232 | 11/1976 | Kamiuchi et al. | 427/116 |
| 4,179,796 | 12/1979 | Allen | 29/605 |
| 4,199,862 | 4/1980 | Gorton, Jr. et al. | 427/116 |

*Primary Examiner*—William R. Dixon, Jr.
*Attorney, Agent, or Firm*—Karl W. Flocks

[57] ABSTRACT

This invention relates to electrical articles having an electrical coil such as high-tension transformers, ignition coils and the like which are excellent in withstand voltage and endurance; and to a method for manufacturing the same. These electrical articles have an electrical coil in which a sheet material such as paper, cloth or non-woven fabric comprising cellulose as major constituent is used as at least a part of interlayer insulator. Said sheet material is characterized by being impregnated with one or more pretreating resins selected from the group consisting of phenolic resins, s-triazine ring compound resins, and phenol-s-triazine ring compound co-condensation resins and further impregnated with a thermosetting resin composition containing an epoxy resin, unsaturated polyester resin, 1,2-polybutadiene resin or silicone resin, said resin being hardened. The electrical articles of this invention are useful as high-tension transformers, ignition coils for internal combustion engines, ignition coils for gas- and petroleum-burners, electromagnetic valves, and solenoides, particularly as resin-molded coils encapsulated with resins and above all as resin-molded ignition coils for automobile engines. Thus, this invention provides electrical articles having an electrical coil excellent in withstand voltage, endurance, corona resistance and moisture resistance and also provides an advantageous method for manufacturing such articles.

23 Claims, 2 Drawing Figures

ELECTRICAL ARTICLE HAVING ELECTRICAL COIL AND METHOD FOR MANUFACTURING SAME

Figure 1:
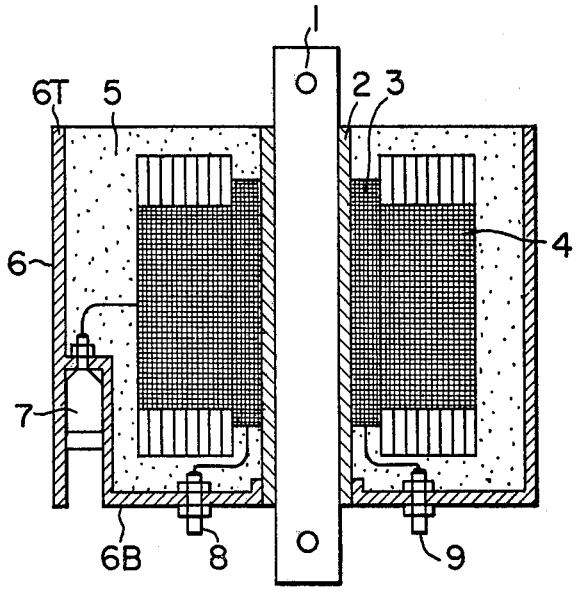

This invention relates to electrical articles having an electrical coil such as high-tension transformers, ignition coils and the like which are excellent in withstand voltage and endurance; and to a method for manufacturing such electrical articles. More particularly, it relates to electrical articles having an electrical coil in which a sheet of paper, cloth or non-woven fabric comprising cellulose as major constituent is used as at least a part of interlayer insulator, characterized in that the sheet is at first impregnated with one or more pretreating resins (a) selected from the group consisting of phenolic resins, s-triazine ring compound resins and phenol-s-triazine ring compound co-condensation resins and then impregnated with a thermosetting resin composition (b), and said pretreating resin (a) and said thermosetting resin composition (b) are hardened; and also relates to a method for manufacturing such an electrical article.

This invention further relates to electrical articles having a resin molded coil and a method for the manufacture thereof, in which coil a sheet of paper, cloth, non-woven fabric or the like comprising cellulose as major constituent is employed as at least a part of the interlayer insulator, said sheet having been impregnated with one or more pretreating resins (a) selected from the group consisting of phenolic resins, s-triazine ring compound resins and phenol-s-triazine ring compound co-condensation resins, then impregnated with a thermosetting resin composition (b), and said coil being potted or cast in and encapsulated with a resin composition (c).

This invention still further relates to electrical articles having a resin molded coil and a method for the manufacture thereof, in which coil a sheet of paper, cloth, non-woven fabric or the like comprising cellulose as major constituent is used as at least a part of the interlayer insulators, said sheet having been impregnated with one or more pretreating resins (a) selected from the group consisting of phenolic resins, s-triazine ring compound resins and phenol-s-triazine ring compound co-condensation resins and then said coil including the pretreated sheet is potted or cast in and encapsulated with a liquid thermosetting resin.

Recently, electrical coils for use in high-tension transformers, ignition coils for internal combustion engines and the like are required more and more ardently to be reduced in size, further improved in quality and in reliability. To meet such requirements, there has been disclosed a resin molded coil which is prepared by winding a conductor together with an insulating paper into a coil, placing the coil in a mold or a casing, pouring a liquid thermosetting resin such as epoxy resins or polyester resins into the mold or casing under a reduced pressure to impregnate the coil with the resin and also to fill the unoccupied space of the mold or casing with the resin, and hardening the liquid resin by heating to integrate them. In such a resin molded coil, however, there exist frequently voids because of insufficient penetration of the resin in the space between conductors held between intervening sheets of insulating paper, and the corona discharge will take place within the voids, thus decreasing the withstand voltage of this type of resin molded coil. A method has been disclosed to overcome the difficulty which comprises thoroughly drying the mounted coil and impregnating the dried coil with a low-viscosity epoxy resin over a long period of time under a high vacuum of 0.1 mmHg or less. Although capable of producing a resin molded coil having scarcely voids between conductors, this method presents not only a problem of requiring a prolonged period of time for the resin impregnation but also a problem of minute voids being left within the insulating paper due to the difficulty of penetration of resin into inter-fiber and intra-fiber minute spaces, which minute voids together with the existence of hydroxyl groups (which are undesirable for the electric performance of insulating paper) of cellulose render it difficult to increase satisfactorily the withstand voltage and corona resistance.

In the case of ignition coil for automobile as another example, a higher secondary voltage has become increasingly necessary to keep step with the recent tendencies of automobile engines such as higher speed, higher performance and lower pollution; other requirements for the ignition coil include vibration resistance, reduced size and heat resistance. To meet such requirements, a complete primary and secondary coil assembly made by using insulating paper as inter-layer insulator is inserted in a casing or a mold, then a liquid resin such as an epoxy resin, polyester resin or the like incorporated, if necessary, with an inorganic powder such as powdered silica, calcium carbonate or the like is poured into said casing or mold under a high vacuum to impregnate the coil assembly with the resin and the resin is hardened by heating to produce a resin molded ignition coil which is now in actual use. In such an ignition coil, however, since the conductor of secondary coil is very fine (for example, 0.05–0.07 mmϕ), penetration of the resin into small gaps between the coiled conductors held between interlayer insulators is unsatisfactory, resulting in many small voids; moreover, thorough penetration of the resin into fibrous structure of the insulating paper such as condenser paper is quite difficult, leaving behind a great many minute voids within the insulator. The corona discharge which occurs in the above-said two types of voids tends to cause layer short circuit within the secondary coil, making it difficult to increase the output voltage. As a means for preventing the voids, there is known a method which comprises immersing a complete coil assembly in a low-viscosity epoxy resin under a high vacuum, then repeatedly applying pressure and vacuum, thereafter withdrawing the coil assembly out of the liquid resin, heating it to obtain a treated coil assembly impregnated with semi-hardened or completely hardened resin, then placing the treated coil in a mold or a casing, filling the mold or casing with an epoxy resin incorporated with an inorganic powder under high vacuum, and then hardening the resin at atmospheric pressure. This method, however, requires a long period of time to eliminate voids and, in addition, presents a problem of unsatisfactory impregnation of fibers in the interlayer insulators. This method has a further problem of regeneration of voids by the oozing of the impregnated epoxy resin out of the coil when the latter immersed in the resin is withdrawn out of the low-viscosity epoxy resin and then the resin is hardened.

In order to solve the problems enumerated above and to improve the performance characteristics of the electrical coil such as withstand voltage, moisture resistance, heat resistance, endurance, etc., the present inventors have conducted extensive studies on the electrical coil having no voids between the windings and no minute voids within the interlayer insulator and, as a result, have accomplished the present invention.

An object of this invention is to provide electrical articles such as high-voltage transformer, ignition coil for internal combustion engines, ignition coil for gas- and petroleum-burners, electromagnetic valve and solenoid having an electrical coil excellent in withstand voltage, endurance, corona resistance and moisture resistance and also to provide an advantageous method for manufacturing the same.

Another object of this invention is to provide electrical articles having a supreme-quality electrical coil suitable for the resin molded coil, which is encapsulated with molded resin, particularly for the resin molded ignition coil for automobile engines and also to provide an economically advantageous method for manufacturing the same.

A further object of this invention is to provide electrical articles having an electrical coil which is prevented from dielectric breakdown due to the winding layer short circuit as well as from moisture absorption of the interlayer insulator and is excellent in withstand voltage and in endurance under severe use conditions; particularly a resin molded ignition coil suitable for a small-size resin molded high-tension coil, especially suitable for an automobile ignition coil.

Other objects and advantages of this invention will become apparent from the following description.

According to this invention, there is provided an electrical article having an electrical coil in which a sheet material selected from the group consisting of paper, cloth and non-woven fabrics comprising cellulose as major constituent is used as at least a part of interlayer insulator, characterized in that the sheet is at first impregnated (pretreated) with one or more pretreating resins (a) selected from the group consisting of phenolic resins, s-triazine ring compound resins and phenol-s-triazine ring compound co-condensation resins and then with a thermosetting resin composition (b), and said pretreating resin (a) and said thermosetting resin composition (b) are hardened; and also a method for manufacturing such an electrical article.

Figure 2:
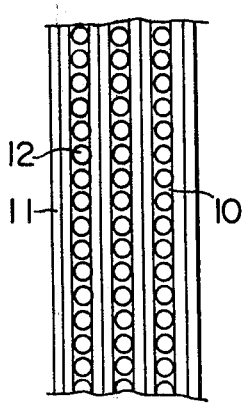

This invention is illustrated below in detail with reference to the accompanying drawings, in which FIG. 1 is a sectional view of a resin molded ignition coil to illustrate an example of electrical articles having an electrical coil according to this invention; and FIG. 2 is an enlarged cross-sectional view of a portion of the secondary coil of the ignition coil shown in FIG. 1.

In both Figs., 1 is iron core, 2 bobbin, 3 primary coil, 4 secondary coil, 5 resin composition, 6 casing, 7 high-voltage terminal, 8 and 9 primary terminals, 10 gap between windings, 11 interlayer insulator impregnated (pretreated) with a pretreating resin, and 12 winding.

In FIG. 1, the primary coil 3 is formed by winding around the bobbin 2, and the secondary coil 4 is formed by winding long the periphery of the primary coil 3. The resulting coil assembly is kept in place in the casing 6 which is molded from a synthetic resin or the like. One end of the primary coil 3 is connected to the primary terminal 8 provided through the casing wall, while the other end is connected to the low voltage side of the secondary coil 4 as well as to another primary terminal 9. The high voltage side of the secondary coil 4 is connected to the high voltage terminal 7 provided through the casing wall. As shown in the enlarged sectional view (FIG. 2), the secondary coil 4 is composed of interlayer insulators 11 and windings 12. A resin composition (c) or a thermosetting resin composition (b) such as, for example, an epoxy resin composition, is molded in the casing 6, whereby the coil assembly is encapsulated and integrated with the resin. The interlayer insulator 11 of paper, cloth or a non-woven fabric comprising cellulose as major constituent in the secondary coil 4 is impregnated with a pretreating resin (a) such as, for example, a phenolic resin, then hardened and further impregnated with a thermosetting resin (b) such as, for example, an epoxy resin composition, which is also hardened. The gap 10 enclosed by the interlayer insulator 11 and the winding 12 is filled with a thermosetting resin (b) such as, for example, an epoxy resin composition which is then hardened. Iron core 1 is inserted through the bobbin 2 into the casing 6 to form the resin-molded ignition coil.

The method for manufacturing an electrical article having an electrical coil according to this invention is described below by referring to the above resin molded ignition coil as an example.

The secondary coil 4 is wound by using as at least a part of the interlayer insulators a sheet material such as paper, cloth or a non-woven fabric comprising cellulose as major constituent. The coil is dipped in a pretreating resin varnish (a) such as, for example, a phenolic resin varnish. After the varnish has sufficiently penetrated into the coil, the impregnated coil is withdrawn out of the resin bath and dried thoroughly by heating to harden the resin. The pretreated secondary coil is placed in a vacuum tank at 0.1–3 mmHg and a thermosetting resin composition (b) such as, for example, a liquid epoxy resin composition is introduced to immerse the coil in the resin composition. The coil is then withdrawn out of the tank and heated to harden the resin. The thus treated secondary coil 4 and a primary coil 3 are placed in casing 6. Both coils are connected to the terminals by soldering, then placed with the casing bottom 6B downward in a vacuum tank and applied at a vacuum of 0.1 to 3 mmHg. A resin composition (c) such as, for example, a liquid epoxy resin composition containing an inorganic powder is introduced into the casing 6 from the top 6T to immerse the coil assembly in the resin composition while avoiding the entrapped air. The impregnated coil assembly is taken out of the vacuum tank and the resin is hardened by heating to obtain a resin molded ignition coil.

The structure of the electrical article having the electrical coil according to this invention and the method for manufacturing the same are not limited to the resin molded ignition coil and the method for manufacturing the same as exemplified above, but applicable to various electrical articles having electrical coils.

Sheet materials such as paper, cloth, non-woven fabrics and the like comprising cellulose as major constituent used in this invention include those generally used as interlayer insulators for coils, such as, for example, insulating papers, e.g. condenser paper. Sheets made from mixtures of fibrous cellulosic materials and fibrous glass or mica may be used. Further, the fibrous cellulose materials may be used cojointly with a mica sheet, synthetic resin film, glass cloth and glass paper. Such sheet materials are used not only as interlayer insulators of a coil but also as insulators between the coil and iron core (spacers between the primary coil and the secondary coil).

The pretreating resin varnish (a) for use in this invention is prepared from one or more resins selected from the group consisting of phenolic resins, s-triazine ring compound resins and phenol-s-triazine ring compound co-condensation resins.

The phenolic resins, as herein referred to, include resins obtained by the reaction of formaldehyde with one or more phenols such as phenol, cresol, xylenol, catechol, resorcinol, bisphenol-A and other monohydric and dihydric phenols and derivatives thereof. Suitably modified phenolic resins may also be used. Of these phenolic resins, resol-type resins having methylol groups are preferred; most preferred are resol-type phenolic resins having an average molecular weight of 350 or less which contain methylol compounds having three or less nuclei.

The s-triazine ring compound resins, as herein referred to, include those resins which are produced by the reaction of formaldehyde with one or more s-triazine ring compounds such as melamine, benzoquanamine, acetoguanamine, and substituted derivatives thereof. Resins containing methylol groups and three or less nuclei as major constituent are preferred. Suitably modified resins are also used.

The phenol-s-triazine ring compound co-condensation resins used in this invention are those produced by the reaction of one or more above-mentioned phenols, one or more above-mentioned s-triazine ring compounds and formaldehyde. Preferred resins are those containing methylol groups and three or less nuclei as major constituent. Suitably modified resins may also be used.

In the present invention, the pretreating resins mentioned above are used in the form of varnish in impregnating (pretreating) interlayer insulators. The varnish is prepared by dissolving or dispersing the resins in one or more solvents such as alcohols, e.g. methyl alcohol, ethyl alcohol, isopropyl alcohol and butanol; ketones, e.g. acetone and methyl ethyl ketone; aromatic hydrocarbons, e.g. benzene and toluene; and water. The pretreating resin content of the impregnated interlayer insulator pretreated with the pretreating resin varnish is 3 to 100, preferably 5 to 40 parts by weight on solids basis per 100 parts by weight of the sheet material.

The thermosetting resin compositions (b) in this invention are those which have been conventionally used in insulating treatment of electrical coils. Examples thereof are liquid compositions of resins having polymerizable double bonds, such as unsaturated polyester resins and 1,2-polybutadiene resins; epoxy resin compositions; polyimide resin compositions; silicone resin compositions; and urethane resin compositions. These resin compositions for impregnation are preferably liquid resin compositions without using a solvent and are hardenable by heating after impregnation. If necessary, these resin compositions can be suitably incorporated with powdered inorganic materials such as powders of silica, alumina, calcium carbonate and talc. Another form of the liquid resin compositions is solid resins dissolved in solvents which, after impregnation of the sheet materials and drying, melt and then harden by heating during the specified process.

The epoxy resin compositions in this invention are combinations of epoxy compounds, hardeners and hardening accelerators. Examples of suitable epoxy compounds are those prepared by reacting, for example, polyhydric phenols, polyhydric polynuclear phenols or aliphatic polyhydric alcohols with epihalohydrins or dihalohydrins in the presence of alkali catalysts in the known manner; and those known epoxy compounds which are prepared by epoxidizing alicyclic or aliphatic compounds containing diene linkages by oxidization with peracids. The hardeners and hardening accelerators are aliphatic or aromatic polyamines, polyamides, acid anhydrides, diaminodiphenylmethane, dicyandiamide, xylenediamine, $BF_3$-amine complexes, benzyldimethylamine and imidazole. In this invention, particularly useful hardeners include, for example, phthalic anhydride, itaconic anhydride, succinic anhydride, citraconic anhydride, dodecenylsuccinic anhydride, tricarballylic anhydride, maleic anhydride, the maleic anhydride adduct of methylcyclopentadiene, alkylated endoalkylenetetrahydrophthalic anhydride, the linolenic acid adduct of maleic anhydride, chlorendic anhydride, methyl-2-substituted-butenyltetrahydrophthalic anhydride, hexahydrophthaliic anhydride, methyltetrahydrophthalic anhydride, pyromellitic anhydride, cyclopentanetetracarboxylic anhydride, benzophenonetetracarboxylic anhydride, maleic anhydride-vinyl ether copolymer, maleic anhydride-styrene copolymer, ethylene glycol bistrimetllitate, and glycerol tristrimellitate.

The unsaturated polyester resins, as herein referred to, are those prepared from unsaturated or saturated acids such as, for example, maleic anhydride, fumaric acid, itaconic acid, phthalic anhydride, isophthalic acid, tetrahydrophthalic anhydride and terephthalic acid and diols such as, for example, ethylene glycol and propylene glycol. These unsaturated polyesters are used together with copolymerizable monomers, which serves as crosslinking agents, such as, for example, styrene, t-butylstyrene and methyl methacrylate and polymerization initiators such as, for example, benzoyl peroxide and di-t-butyl peroxide.

The pretreatment with pretreating resins (a) and the impregnation with thermosetting resin compositions (b) according to this invention can be carried out by any of the following methods:

(I) A coil wound by using a sheet material and a conductor is impregnated with a pretreating resin varnish and then further impregnated with a thermosetting resin composition.

(II) A sheet material is impregnated with a pretreating resin varnish, then using the resulting sheet material and a conductor a coil is wound and the coil is impregnated with a thermosetting resin composition.

(III) A sheet material is impregnated with a pretreating resin varnish, then with a thermosetting resin composition, and a coil is wound by using the thus treated sheet material and a conductor.

The impregnation with a pretreating resin varnish can be carried out under subatmospheric, atmospheric or superatmospheric pressure. Thereafter, the impregnated material or coil is dried to remove the solvent and to convert the pretreating resin into semihardened or completely hardened state. In impregnating with a thermosetting resin composition (b), when the method (I) or (II) is used, it is preferable to carry out the impregnation by using a liquid thermosetting resin composition under a vacuum of 10 mmHg or less. If the method (III) is used, it is economically advantageous to use a liquid or dissolved thermosetting resin composition at atmospheric pressure. In any of the methods, after impregnation with a thermosetting resin composition, the resin is hardened by heating a complete coil assembly.

When the method (I) or (II) is used, it is possible to obtain a resin-molded coil by placing the pretreated coil in a mold or a casing, then pouring a liquid thermosetting resin composition so as to fill the unoccupied space in the mold or casing to effect simultaneously impregnation and potting, and hardening the resin by heating to integrate the coil and the resins.

The resin-molded coil can also be obtained by potting the coil in a thermosetting resin composition (c) to encapsulate the coil including a sheet material which has been pretreated and impregnated by any of the methods (I), (II) and (III).

The resins suitable for use in the resin composition (c) are liquid thermosetting resins such as unsaturated polyester resins, polymerizable double bond-containing resins such as 1,2-polybutadiene resin, epoxy resins, silicone resins and urethane resins. Examples of such epoxy resins and unsaturated polyester resins are similar to those mentioned above. These thermosetting resins can be incorporated with suitable inorganic powders such as powders of silica, alumina, calcium carbonate and talc. The potting and encapsulating of a coil with a liquid thermosetting resin composition is carried out by inserting the coil into a casing or a mold, casting said resin composition in said mold or casing, and then hardening the resin by heating.

Suitable for use as the resin composition (c) are those which are solid at room temperature and meltable on heating, including molding materials of thermoplastic resins such as polypropylene, nylon and polybutylene terephthalate as well as molding materials of thermosetting resins such as phenolic resins, epoxy resins, unsaturated polyester resins, diallyl phthalate resin, and silicone resins. When these molding materials are used, the resin-molded coil can be obtained by inserting the coil into a mold and molded by the method of compression molding, transfer molding, or injection molding to encapsulate the coil.

There exists a suitable combination between the pretreating resin varnish (a) and the impregnating thermosetting resin composition (b). If the former contains only a s-triazine ring compound resin, any thermosetting resin is suitable for use in combination with it, whereas if the pretreating resin varnish (a) contains at least a portion of either phenolic resin or phenol-s-triazine ring compound co-condensation resin, an epoxy resin is the most suitable resin for use in combination.

The reasons why electrical articles having an electrical coil of this invention are excellent in withstand voltage, corona resistance, endurance, and moisture resistance seem to be as follows: since the sheet material comprising cellulose as major constituent is hydrophilic, penetration of the conventional hydrophobic insulating resin into the sheet material is difficult and there remain minute voids in the sheet; such voids together with the electrically active hydroxyl groups of cellulose give rise to unsatisfactory corona resistance and insufficient withstand voltage of the resulting coil. To the contrary, according to this invention, because of the hydrophilicity of the pretreating resin, it penetrates sufficiently into the sheet material to fill the voids existing between and within cellulose fibers and combines chemically with hydroxyl groups of cellulose; and upon hardening by heat, the resin becomes hydrophobic to improve its insulatory performance. The pretreatment according to this invention not only eliminates the voids to improve the electric performance of the sheet material itself but also enhances the affinity between the sheet material and the thermosetting resin, resulting in unsatisfactory penetration of the latter into the voids existing between the sheet materials and between the conductors [for example, voids 10 in FIG. 2] to improve the withstand voltage and heat resistance of the finished electrical coil.

The electrical articles having electrical coils of this invention are useful as high-tension transformers, electric motors, ignition coils for internal combustion engines, ignitors for gases and petroleum burners, electromagnetic valves, solenoids, etc., particularly as small-size high-tension transformers and ignition coils of the resin-mold type. The most useful application is a resin-molded ignition coil for automobile.

Another advantage of this invention resides in the economical aspect. Since the pretreatment according to this invention not only eliminates the voids within the sheet material but also improves the affinity between the sheet material and the hydrophobic insulating resin, the impregnation with the latter becomes complete very rapidly.

The invention is further illustrated below with reference to Examples, but the invention is not limited thereto.

EXAMPLE 1

A mixture of 50 parts by weight of m-cresol, 50 parts by weight of p-cresol and 125 parts by weight of formalin (37% by weight aqueous formaldehyde solution) was admixed with a small amount of aqueous ammonia and allowed to react under reflux for 1.5 hours. After dehydration in vacuo, the reaction mixture was diluted with a methanol-isopropanol (7:3) mixture to obtain a pretreating resin varnish containing 25% by weight of resin.

Using a condenser paper as interlayer insulator, primary and secondary coils were wound around a bobbin and mounted to an iron core to prepare a transformer coil for a high-tension measuring instrument. The coil was immersed in the pretreating varnish, obtained above, under a vaccum of 40 mmHg for 30 minutes. After removing from the varnish bath, the coil was dried for 50 minutes at 80° C., then for 5 hours at 130° C. to harden the resin. The resulting pretreated coil was immersed in a liquid resin composition prepared by mixing a bisphenol-A-based liquid epoxy resin and an acid anhydride hardener. After impregnation by applying a vacuum of 0.1 mmHg and then a nitrogen pressure of 6 kg/cm$^2$, the coil was heated to harden the resin at 80° C. for 2 hours, then at 120° C. for 13 hours to obtain a transformer coil for high-tension measurement.

EXAMPLE 2

A mixture of 70 parts by weight of melamine, 30 parts by weight of p-toluene-sulfonamide and 55 parts by weight of paraformaldehyde was allowed to react in 100 parts by weight of butanol at 70°-80° C. for 2 hours. After cooling, the reaction mixture was diluted with acetone to obtain a pretreating resin varnish of 23% by weight resin content.

Using a condenser paper as interlayer insulator, primary and secondary coils were wound around a bobbin and mounted to an iron core to prepare a transformer coil for a high-tension measuring instrument, the same as in Example 1. The coil was immersed in the pretreating varnish, obtained above, for 30 minutes under a vacuum of 40 mmHg. After removing from the varnish bath, the coil was dried at 80° C. for 50 minutes and at 130° C. for 5 hours to harden the resin and to obtain a pretreated coil. The pretreated coil was immersed in the same liquid resin composition as in Example 1, which was prepared by mixing a bisphenol-A-based liquid epoxy resin and an acid anhydride hardener. After impregnation by applying a vacuum of 0.1 mmHg and then a pressure of 6 kg/cm$^2$, the coil was heated to harden the resin at 80° C. for a 2 hours and then at 120° C. for 13 hours to obtain a transformer coil for high-tension measurement.

EXAMPLE 3

A mixture of 80 parts by weight of benzoguanamine, 100 parts by weight of phenol and 165 parts by weight of formalin (37% by weight aqueous formaldehyde solution) was allowed to react under reflux in the presence of sodium hydroxide as catalyst. After the mixture had become a clear and uniform solution, the reaction was continued for further 2.5 hours. After dehydration in vacuo, the reaction mixture was diluted with methanol to obtain a pretreating resin varnish containing 25% by weight of the resin.

Using a condenser paper as interlayer insulator, primary and secondary coils were wound around a bobbin and mounted to an iron core to prepare a transformer coil for a high-tension measuring instrument, the same as in Example 1. The coil was immersed in the pretreating varnish, obtained above, for 60 minutes. After removing from the varnish bath, the coil was dried at 80° C. for 50 minutes, then at 130° C. for 5 hours to harden the resin. The resulting pretreated coil was immersed in the same liquid resin composition as in Example 1, which was prepared by mixing a bisphenol-A-based liquid epoxy resin and an acid anhydride hardener. After impregnation under application of a vacuum of 0.1 mmHg and then a pressure of 6 kg/cm$^2$, the coil was heated at 80° C. for 2 hours, then at 120° C. for 13 hours to harden the resin, giving a transformer coil for high-tension measurement.

COMPARATIVE EXAMPLE 1

Using a condenser paper as interlayer insulator, primary and secondary coils were wound around a bobbin and mounted to an iron core to prepare a transformer coil for a high-tension measuring instrument, the same as in Example 1. The coil was immersed in the same liquid resin composition as in Example 1, which was prepared by mixing a bisphenol-A-based liquid resin composition and an acid anhydride hardener. After impregnation under application of a vacuum of 0.1 mmHg and then a pressure of 6 kg/cm$^2$, the coil was heated to harden the resin at 80° C. for 2 hours, then at 120° C. for 13 hours to obtain a transformer coil for a high-tension measuring instrument.

The coils obtained in Examples 1 to 3 and Comparative Example 1 were cut and each section was examined under magnification. The section of unpretreated coil of Comparative Example 1 showed voids between conductors and those white paper fibers all over the section which came loose from the condenser paper. To the contrary, three coils obtained in Examples 1 to 3 showed neither void nor fibers of the condenser paper. Upon examination under an electron microscope at a magnification of 3,000, it was found that unpretreated coil showed many voids within the condenser paper, whereas in three cases of pretreated coils, interfiber minute gaps were completely filled with the resin.

On measurement of the dielectric breakdown voltage of the secondary coils, it was found that the value of unpretreated coil was 28 kV, whereas those of three pretreated coils were 50 kV or higher.

EXAMPLE 4

A sheet of condenser paper was immersed in the same pretreating resin varnish as used in Example 1 and then dried to obtain a pretreated paper sheet containing 12% of semi-hardened resin. Using this sheet material as interlayer insulator, a coil was wound in the same manner as in Example 1 and mounted to an iron core to prepare a transformer coil for a high-tension measuring instrument. The coil was immersed in the same liquid epoxy resin composition as used in Example 1, and thereafter treated in the same manner as in Example 1 to obtain a finished coil.

EXAMPLE 5

A blended fiber paper (50% by weight in glass content) made from a glass paper and a linter pulp was immersed in the same pretreating resin varnish as used in Example 1 and then dried to obtain a pretreated paper sheet containing 8% by weight of semi-hardened resin. This sheet material was impregnated by coating with an epoxy resin solution composition containing a bisphenol-A-based solid epoxy resin, dicyandiamide and a hardening accelerator. The impregnated sheet material was dried to obtain a paper sheet containing 62% by weight in total of the semi-hardened resins. Using this sheet material as interlayer insulator, a coil was wound in the same manner as in Example 1 and mounted to an iron core. The assembly was heated to harden the resin at 160° C. for 4 hours to obtain a finished coil.

The dielectric breakdown voltage of each secondary coil of the coils obtained in Examples 4 and 5 was 50 kV or higher.

EXAMPLE 6

A coil wound by use of an insulating paper was immersed in a varnish of phenol resin in methanol prepared by the reaction of 100 parts by weight of phenol and 120 parts by weight of 37% by weight formalin in the presence of dimethylamine catalyst. After the immersion was continued for 30 minutes, the coil was dried by heating at 80° C. for 30 minutes, then at 130° C. for 5 hours. The coil was disposed in a mold and, under a vacuum of 0.1 mmHg, covered with a liquid resin composition containing an acid anhydride hardener and a bisphenol-A-based epoxy resin as major constituents and 25% by weight, based on the total composition, of powdered silica. The coil and the resin composition were then applied with an air pressure of 5 kg/cm$^2$ and thereafter heated to harden the resin in a curing oven at 130° C. for 15 hours to obtain an integrated resin-molded coil.

EXAMPLE 7

A benzoguanamine resin prepared by the reaction of 100 parts by weight of benzoguanamine and 150 parts by weight of 37% (weight) formalin in the presence of sodium carbonate catalyst was dissolved in an acetone-water (4:1) mixture to obtain a benzoguanamine resin varnish. A sheet of insulating paper was coated with the varnish and dried. Using the resulting sheet material, a coil was wound, disposed in a synthetic resin casing and, under a vacuum of 10 mmHg, impregnated with a liquid resin composition containing an unsaturated polyester, t-butylstyrene, an initiator, and 40% by weight, based on the total composition, of powdered calcium carbonate. Thereafter, a nitrogen pressure of 5 kg/cm$^2$ was applied and then the whole was heated to harden the resin at 120° C. for 3.5 hours to obtain a block of resin-molded coil.

EXAMPLE 8

A mixture of 40 parts by weight of acetoguanamine, 60 parts by weight of cresol (60% by weight of m-cresol and 40% by weight of p-cresol) and 50 parts by weight of paraformaldehyde was allowed to react in methanol in the presence of sodium hydroxide catalyst to obtain a methanol solution of acetoguanamine-cresol co-condensation resin. A coil was wound using an insulating paper and immersed in said methanol solution under a vacuum of 40 mmHg for one hour. The coil was then dried at 60° C. for 3 hours, then at 100° C. for 2 hours, and immersed in the same epoxy resin composition as used above except for the powdered silica. After immersion under a vacuum of 0.1 mmHg for 30 minutes and subsequent application of an air pressure of 4 kg/cm$^2$, the coil was removed from the resin composition bath and heated at 100° C. for 5 hours, then at 130° C. for 10 hours to harden the resin. The coil thus treated was disposed in a synthetic resin casing and covered at 80° C. with a resin composition containing 100 parts by weight of the above-said epoxy resin composition and 150 parts by weight of powdered silica. After having been defoamed under a vacuum of 5 mmHg for 3 hours, the coil potted with the resin was heated to harden the resin at 130° C. under atmospheric pressure for 15 hours to obtain an integrated resin-molded coil.

COMPARATIVE EXAMPLE 2

A coil wound by using an insulating paper was thoroughly dried, then disposed in a mold, and impregnated with a resin composition in the same manner as in Example 6. After hardening of the resin by heating, an integrated resin-molded coil was obtained.

The characteristics of the resin-molded coils obtained in Examples 6 to 8 and Comparative Example 2 were as shown in Table 1.

TABLE 1

| | Characteristics of resin-molded coils. | | |
|---|---|---|---|
| Example No. | Pretreating resin content of insulating paper (% by weight) | Dielectric breakdown voltage of high-tension coil (kV) | Examination of section of coil |
| 6 | 15 (phenolic resin) | 50< | Good; no void |
| 7 | 10 (benzoguanamine resin) | 50< | Good; no void |
| 8 | 23 (acetoguanamine-cresol co-condensation resin) | 50< | Good; no void |
| Comparative Example 2 | — | 24 | Some voids; loose fibers are observed. |

It is apparent from the results shown in Table 1 that the resin-molded coil according to this invention has an excellent withstand voltage and is suitable particularly for a high-tension transformer. From the results of examination on the section of coil, it is seen that the resin-molded coil of this invention has no void and, hence, the impregnation with resin is satisfactory.

EXAMPLE 9

A mixture of 100 parts by weight of phenol and 230 parts by weight of 37% (weight) formalin was allowed to react under reflux in the presence of ammonia as catalyst for 2.5 hours. After removal of 85% by weight of water under a reduced pressure, the reaction mixture was diluted with acetone to obtain a phenol resin varnish containing 15% by weight of resin. The average molecular weight of this phenol resin was 215. A secondary coil (15,000 windings) wound by using a condenser paper was immersed in said phenol resin varnish for 30 minutes under atmospheric pressure. After removing from the varnish bath, the coil was dried by heating at 60° C. for one hour, then at 130° C. for 4 hours to obtain a coil containing 16% by weight of phenol resin in the condenser paper. This secondary coil and a primary coil were disposed in a synthetic resin casing as shown in FIG. 1. Into the casing, under a vacuum of 0.1 mmHg, was introduced an epoxy resin composition containing a liquid epoxy resin (Epikote 828 of Shell Chemical Co.) and hexahydrophthalic anhydride as major constituents, a plasticizer, a hardening accelerator, and 30% (weight), based on the total composition, of powdered silica, while heating the composition at 80° C. After subsequent application of a nitrogen pressure of 5 kg/cm$^2$, the coil and the resin composition were heated under atmospheric pressure to harden the resin at 100° C. for 4 hours, then at 130° C. for 6 hours to obtain a resin-molded ignition coil.

EXAMPLE 10

A secondary coil, which had been pretreated with a phenol resin prepared in the same manner as in Example 9, was degassed in a vacuum tank and, under a vacuum of 0.1 mmHg, impregnated with a liquid epoxy resin composition containing an epoxy resin (CY 227 of CIBA Co.) and an acid anhydride hardener (HY 227 of CIBA Co.). After the impregnation under vacuum for one hour, the coil was heated to harden the resin in a hardening oven at 100° C. for 4 hours, then at 140° C. for 4 hours to obtain a resin impregnated coil. The coil was disposed in a synthetic resin casing as shown in FIG. 1. A resin composition containing 100 parts by weight of the epoxy resin composition mentioned above and 115 parts by weight of powdered silica was introduced into the casing under vacuum, while heating the resin composition at 70° C. The whole assembly was heated, under atmospheric pressure, in a curing oven at 100° C. for 4 hours, then at 140° C. for 5 hours to harden the resin and to obtain a resin-molded ignition coil.

EXAMPLE 11

A secondary coil wound by use of a condenser paper in the same manner as in Example 9 was immersed in the same benzoguanamine resin varnish as used in Example 7. After drying, t the resin. The coil disposed in a resin casing in the same manner as in Example 9 was covered, under atmospheric pressure, with a resin composition containing 1,2-polybutadiene resin, benzoyl peroxide, cobalt naphthenate and powdered silica, the resin content of the composition having been 80% by weight. The assembly was degassed in a vacuum tank at room temperature for 30 minutes and then heated under atmospheric pressure in a curing oven at 100° C. for 4 hours to harden the resin, giving a resin-molded ignition coil.

EXAMPLE 12

A resin impregnated coil obtained in the same manner as in Example 10, a primary coil wound around a bobbin, terminal pieces, and iron core were assembled in a mold. Polypropylene was injected into the mold by injection molding to obtain a resin-molded ignition coil.

EXAMPLE 13

Example 12 was repeated, except that in place of the polypropylene an epoxy resin molding powder comprising a novolak-epoxy resin, a phenol novolak resin, a hardening accelerator (imidazole), an inorganic powder material, release agent, and colorant was injected into the mold at 170° C. by transfer molding. On hardening of the molding powder, the coil was embedded to obtain a resin-molded ignition coil.

COMPARATIVE EXAMPLE 3

Example 10 was repeated, except that the secondary coil pretreated with the phenol resin was replaced by a secondary coil wound by using a condenser paper as such after drying by heating at 105° C. for 10 hours. The impregnation with the resin and the casting were carried out in the same manner as in Example 10 to obtain a resin-molded ignition coil.

The characteristics of the resin-molded ignition coils obtained in Examples 9 to 13 and Comparative Example 3 were as shown in Table 2. As is apparent from Table 2, the resin-molded ignition coils according to this invention were excellent in withstand voltage.

TABLE 2

| | Characteristics of resin-molded ignition coil. | | |
|---|---|---|---|
| Example No. | Pretreating resin content of condenser paper (%) | Dielectric breakdown voltage (kV) | Examination of section of coil |
| 9 | 16 (phenol resin) | 50< | Good; no void |
| 10 | 16 (phenol resin) | " | Good; no void |
| 11 | 9 (benzoguanamine resin) | " | Good; no void |
| 12 | 16 (phenol resin) | " | Good; no void |
| 13 | 16 (phenol resin) | " | Good; no void |
| Comparative Example 3 | — | 45 | Many minute voids; loose fibers are observed |

The results of inspection of the section of each coil were as shown in the fourth column of Table 2. The coil of Comparative Example 3 showed voids between windings under a magnification of 20 and fragments of white fiber come loose from the interlayer insulator can be seen with unaided eye. The coils obtained in Examples 9 to 13 showed neither voids between windings nor fiber fragments; even under a magnification of 3,000 no void was perceptible within the interlayer insulator, between fibers and within the fiber, indicating satisfactory impregnation with resins.

What is claimed is:

1. An electrical article having an electrical coil in which a sheet of paper, cloth or non-woven fabric comprising cellulose as major constituent is used as at least a part of interlayer insulator, characterized in that the sheet is preliminarily impregnated with (a) one or more pretreating resins selected from the group consisting of phenolic resins, s-triazine ring compound resins and phenol-s-triazine ring compound co-condensation resins and further impregnated with (b) a thermosetting resin composition, and said pretreating resin (a) and said thermosetting resin composition (b) are hardened.

2. An electrical article having an electrical coil according to claim 1, wherein said electrical coil is further molded and encapsulated with a resin composition (c).

3. An electrical article having an electrical coil according to claim 1, wherein the thermosetting resin composition (b) is a liquid thermosetting resin composition and the impregnation of the sheet with said resin composition (b) is effected by casting the electrical coil having said sheet as interlayer insulator with the resin composition (b), and the coil is encapsulated with the resin composition (b).

4. An electrical article having an electrical coil according to claim 2, wherein the thermosetting resin composition (b) is a liquid epoxy resin composition.

5. An electrical article having an electrical coil according to claim 2, wherein the thermosetting resin composition (b) is a liquid epoxy resin composition, the resin composition (c) is a liquid epoxy resin composition, and said resin composition (c) is hardened.

6. An electrical article having an electrical coil according to claim 2, wherein the pretreating resin (a) is a phenolic resin, the thermosetting resin composition (b) is a liquid epoxy resin composition, the resin composition (c) is a liquid epoxy resin composition, and said resin composition (c) is hardened.

7. An electrical article having an electrical coil according to claim 6, wherein the pretreating resin (a) is a phenolic resin of the resol type having an average molecular weight of 350 or less; the thermosetting resin composition (b) is a liquid epoxy resin composition containing at least an acid anhydride as hardener; and the resin composition (c) is a liquid epoxy resin composition containing at least an acid anhydride as hardener.

8. An electrical article having an electrical coil according to claim 3, wherein the thermosetting resin composition (b) is a liquid epoxy resin composition.

9. An electrical article having an electrical coil according to claim 3, wherein the pretreating resin (a) is a phenolic resin and the thermosetting resin composition (b) is a liquid epoxy resin composition.

10. An electrical article having an electrical coil according to claim 9, wherein the pretreating resin (a) is a phenolic resin of the resol type having an average molecular weight of 350 or less and the thermosetting resin composition (b) is a liquid epoxy resin composition containing at least an acid anhydride as hardener.

11. An electrical article having an electrical coil according to claim 2, wherein the pretreating resin (a) is a s-triazine ring compound resin and the thermosetting resin composition (b) is a liquid resin composition having a polymerizable double bond.

12. An electrical article having an electrical coil according to claim 2, wherein the pretreating resin (a) is a s-triazine ring compound resin; the thermosetting resin composition (b) is a liquid resin composition having a polymerizable double bond; the resin composition (c) is a liquid thermosetting resin composition having a polymerizable double bond; and said resin composition (c) is hardened.

13. An electrical article having an electrical coil according to claim 2, wherein the pretreating resin (a) is a s-triazine ring compound resin; the thermosetting resin composition (b) is a liquid resin composition having a polymerizable double bond; the resin composition (c) is an epoxy resin composition; and said resin composition (c) is hardened.

14. An electrical article having an electrical coil according to claim 3, wherein the pretreating resin (a) is a s-triazine ring compound resin and the thermosetting resin composition (b) is a resin composition having a polymerizable double bond.

15. An electrical article having an electrical coil according to any one of claims 2 to 14, wherein said electrical article having an electrical coil is a resin-molded ignition coil.

16. A method for manufacturing an electrical article having an electrical coil in which a sheet material selected from the group consisting of paper, cloth and non-woven fabrics comprising cellulose as major constituent is used as at least a part of interlayer insulator, which comprises the pretreatment step consisting of impregnating said sheet material with a varnish of (a) a pretreating resin containing one or more resins selected from the group consisting of phenolic resins, s-triazine ring compound resins, and phenol-s-triazine ring compound co-condensation resins, and then drying to bring said pretreating resin (a) to semi-hardened or completely hardened state; the impregnation step consisting of impregnating the pretreated sheet material with (b) a thermosetting resin composition; and the final step of hardening said pretreating resin (a) and said thermosetting resin composition (b).

17. A method according to claim 16, wherein the pretreatment and the impregnation of the sheet material are carried out after the coil had been wound with said sheet material.

18. A method according to claim 16, wherein the pretreatment is carried out before the coil is wound with the sheet material and the impregnation is carried out after the coil has been wound with the sheet material.

19. A method according to claim 16, wherein the pretreatment and the impregnation treatment are carried out before the coil is wound with the sheet material.

20. A method according to any one of claims 16 to 19, wherein as an additional treatment after the impregnation treatment, the wound coil is molded and encapsulated with resin composition (c), to produce a resin-molded coil.

21. A method according to claim 17 or 18, wherein the impregnation treatment is effected by casting and encapsulating the coil with the thermosetting resin composition (b) to produce a resin-molded coil.

22. A method for manufacturing an electrical article having an electrical coil, which comprises winding a coil by using as at least a part of interlayer insulator a sheet material selected from the group consisting of paper, cloth and non-woven fabrics comprising cellulose as major constituent; immersing the coil in a varnish of a phenolic resin of the resol type having an average molecular weight of 350 or less; then drying the coil to bring said phenolic resin to semi-hardened or completely hardened state; immersing the resulting coil in a liquid epoxy resin composition; heating the coil to bring said epoxy resin composition to semi-hardened or completely hardened state; then disposing the coil in a casing or a mold; pouring a liquid epoxy resin composition into the casing or mold to encapsulate the coil; and hardening said epoxy resin composition to produce a resin-molded ignition coil.

23. A method for manufacturing an electrical article having an electrical coil, which comprises winding a coil by using as at least a part of interlayer insulator a sheet material selected from the group consisting of paper, cloth and non-woven fabrics containing cellulose as major constituent; immersing the coil in a varnish of a phenolic resin of the resol type having an average molecular weight of 350 or less; drying the coil to bring said phenolic resin to semi-hardened or completely hardened state; then disposing the coil in a casing or a mold; pouring a liquid epoxy resin composition into the casing or mold to encapsulate the coil; and hardening said epoxy resin composition to produce a resin-molded ignition coil.

* * * * *